United States Patent [19]

Wright

[11] Patent Number: 4,880,161

[45] Date of Patent: Nov. 14, 1989

[54] FOAM DISPENSING DEVICE

[75] Inventor: H. Earl Wright, Decatur, Ill.

[73] Assignee: Earl Wright Company, Decatur, Ill.

[21] Appl. No.: 934,639

[22] Filed: Nov. 25, 1986

Related U.S. Application Data

[63] Continuation-in-part of Ser. No. 695,185, Jan. 28, 1985, abandoned.

[51] Int. Cl.[4] ..... B05B 7/04; B65D 37/00

[52] U.S. Cl. ..... 239/330; 222/190; 222/209; 239/343

[58] Field of Search ..... 239/311, 329–331, 239/333, 338, 343, 571; 222/207, 209, 190, 136

[56] References Cited

U.S. PATENT DOCUMENTS

| | | | |
|---|---|---|---|
| 2,365,195 | 12/1944 | Holihan et al. | 239/330 |
| 2,465,274 | 3/1949 | Rudd | 239/330 |
| 2,665,825 | 1/1954 | Poitras et al. | 222/209 |
| 2,988,754 | 6/1961 | Misson | 239/330 X |
| 3,323,689 | 6/1967 | Elmore | 222/209 X |
| 3,709,437 | 1/1973 | Wright | 239/343 |
| 3,937,364 | 2/1976 | Wright . | |
| 3,946,947 | 3/1976 | Schneider . | |
| 4,274,594 | 6/1981 | Ito . | |
| 4,277,030 | 7/1981 | Hechler, IV . | |
| 4,349,131 | 9/1982 | Arabian | 222/383 X |
| 4,429,834 | 2/1984 | Ito . | |
| 4,531,660 | 7/1985 | Ford, Jr. | 222/207 X |

FOREIGN PATENT DOCUMENTS

| | | |
|---|---|---|
| 2925528 | 1/1980 | Fed. Rep. of Germany . |
| 319068 | 3/1957 | Switzerland . |
| 1298491 | 5/1970 | United Kingdom . |

OTHER PUBLICATIONS

Arbitration Hearing reported by Lisa Armstrong, H. Earl Wright, Claimant vs. Ballard Medical Respondents, 5–1986, Ballard Exhibit 144.

Highland Labs. Dispenser, 8/17/78.

*Primary Examiner*—Andres Kashnikow

*Attorney, Agent, or Firm*—Samuels, Miller, Schroeder, Jackson & Sly

[57] ABSTRACT

A device for use with foamable liquids includes a reservoir adapted to contain a quantity of a foamable liquid and an air pump for supplying air to be mixed with the foamable liquid to form a foam. The foamable liquid reservoir is isolated from the air supplying pump. A mixing chamber is provided in which the foamable liquid and air from the air supplying pump can interact to create the foam. A first passage leads from the reservoir of foamable liquid to the mixing chamber and a pump is provided for pumping the foamable liquid from the reservoir through the passage to the mixing chamber. A second passage is provided from the air supplying pump to the mixing chamber to introduce air into the mixing chamber.

1 Claim, 3 Drawing Sheets

FOAM DISPENSING DEVICE

CROSS-REFERENCE TO RELATED APPLICATION

This is a continuation-in-part of U.S. patent application Ser. No. 06/695,185, filed Jan. 28, 1985, now abandoned.

FIELD OF THE INVENTION

This invention relates generally to dispensing devices and more particularly to dispensing devices adapted to effect the formation and discharge of foam from a foamable liquid.

BACKGROUND OF THE INVENTION

Dispensing devices such as those described in Wright, U.S. Pat. No. 3,709,437, issued Jan. 9, 1973 ("Wright 437"), and Wright, U.S. Pat. No. 3,937,364, issued Feb. 10, 1976 ("Wright 364") are known for mixing a foamable liquid held in a reservoir with air to form a foam which can be dispensed from the device. In the Wright 437 device, for instance, mixing of the air and the foamable liquid occurs as the result of the compression of a deformable reservoir of the foamable liquid, or as shown in FIG. 8, by the action of a deformable air bag which when compressed both forces foamable liquid out of the reservoir and forces air to mix with the foamable liquid. Similarly, a deformable reservoir foam dispensing device which is operable in any position is shown in Wright 364. These devices work well, but it is believed that foam dispensing devices specifically designed for reservoirs which are not deformable would be advantageous in some instances.

SUMMARY OF THE INVENTION

The general object of this invention is to provide an improved foam dispensing device. A more particular object is to provide a foam dispensing device which delivers foamable liquid to the mixing area by means of a positive displacement pumping action which simultaneously delivers air to the mixing area.

I have discovered a foam dispensing device which includes a reservoir adapted to contain a quantity of foamable liquid and means for supplying air to be mixed with the foamable liquid to form a foam, the reservoir being isolated from the air supplying means. A mixing chamber is provided in which the foamable liquid and air from the air supplying means can interact to create the foam. A first passage leads from the reservoir of foamable liquid to the mixing chamber and pump means are provided for pumping the foamable liquid from the reservoir through the passage to the mixing chamber. A second passage from the air supplying means to the mixing chamber introduces air into the mixing chamber.

Among the various aspects and features of the present invention may be noted the provision of a foam dispensing device which can be used with non-deformable containers or reservoirs of foamable liquid; the provision of such a dispensing device which can readily be adaptable to a number of different containers of foamable liquids; the provision of such a foam dispensing device which is relatively simple and economical in construction; and the provision of such as foam dispensing device which is reliable in operation. The present invention provides a foam dispensing device for use with a foamable liquid contained in a reservoir which device comprises a mixing chamber in which foamable liquid and air interact to create a foam, characterized by pump means for pumping foamable liquid from the reservoir through a first passage to the mixing chamber, and air supplying means for introducing air through a second passage into the mixing chamber, the reservoir being isolated from the air supplied by the air supplying means.

DETAILED DESCRIPTION OF THE INVENTION

Figure 1:
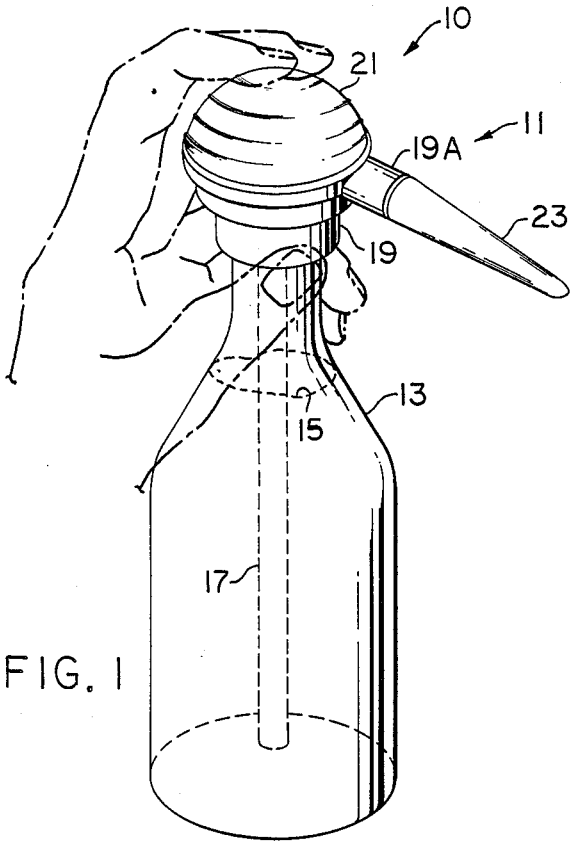
FIG. 1 is a perspective of a foam dispensing device according to the present invention.

This invention is best understood by reference to the drawings. In FIG. 1 there is shown a foam dispensing device 10 of the present invention including a foam producing unit 11 secured to a rigid reservoir 13 of foamable liquid 15. A conduit 17 extends from foam dispensing unit 11 down to near the bottom of reservoir 13 to provide a passage for the foamable liquid from the reservoir to the foam dispensing unit. Unit 11 includes a housing 19 suitably secured at one end to the reservoir 13 and at the other end to a hand bulb 21 which can be operated in the manner indicated by the fingers in FIG. 1. Housing 19 has a generally tubular extension 19A to which is suitably connected to a dispersing nozzle 23.

Figure 2:
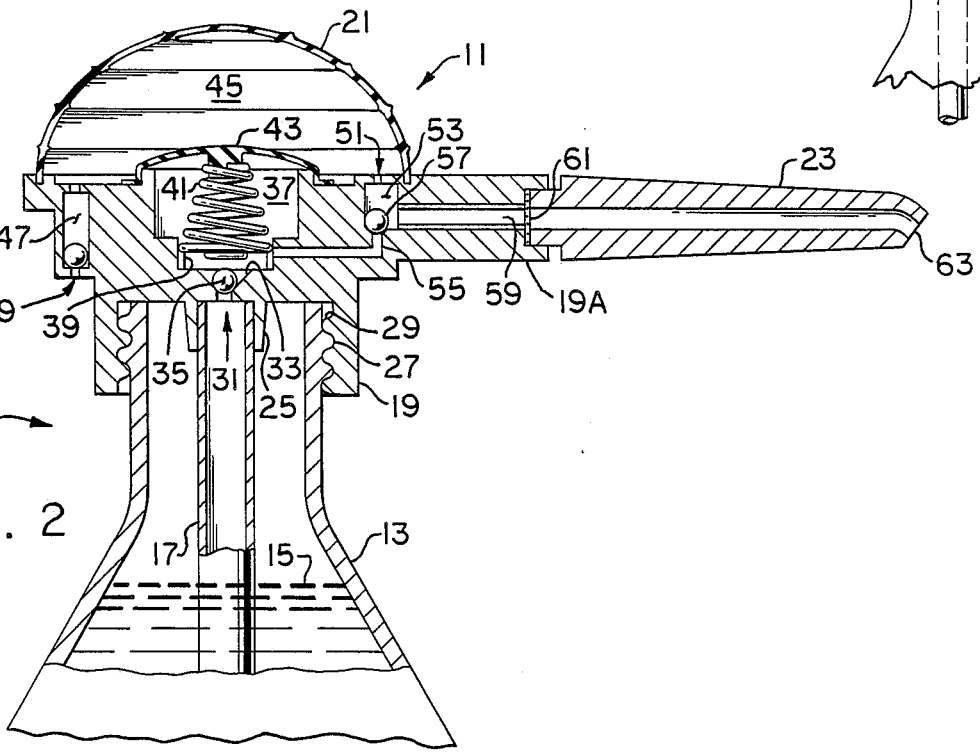
FIG. 2 is a sectional view of the foam producing and dispensing mechanism of the device of FIG. 1.

Turning to FIG. 2, conduit 17 is seen to be suitably secured in an annular depending section 25 of housing 19. Housing 19 also is threaded internally to be secured to the threads 27 on the neck of reservoir 13, the threads of the housing being designated at 29. Immediately above the upper opening of conduit 17, a check valve 31 is disposed which consists of a valve seat 33 and a ball valve 35. Check valve 31 is disposed in a pumping chamber 37 defined by a central recess in housing 19. Pumping chamber 37 includes an annular ledge 39 which supports a spring 41 secured at its other end to a pump diaphragm 43 of rubber or other suitable flexible material. Diaphragm 43 defines the top of pumping chamber 37. The top of diaphragm 43 is exposed to an air reservoir 45 defined by hand bulb 21 and housing 19, and as will become apparent is responsive to the air pressure in air reservoir 45. Diaphragm 43 also isolates foamable liquid in reservoir 13 from the air in air reservoir 45. Air reservoir 45 is connected through a passage 47 and a ball valve 49 to the exterior of foam dispensing device 11. The reservoir is also connected through a second passage (orifice) 51 to a mixing chamber 53 in which the air from reservoir 45 and the foamable liquid from reservoir 13 are mixed to form the foam. A third passage 55 connects pumping chamber 37 with mixing chamber 53, and a third ball valve 57 is provided to prevent retrograde movement of the contents of the mixing chamber into the pumping chamber. An orifice 59 is provided in extension 19A of housing 19 to allow foam produced in the mixing chamber to flow toward nozzle 23. A mixing screen 61 of a fine mesh material or other porous structure is provided at the end of orifice 59 to further mix the foamable liquid and air to form a fine textured foam. This foam is expelled through an orifice 63 defined by nozzle 23.

The operation of the foam dispensing device of FIG. 2 is as follows: When hand bulb 21 is in the position shown in FIG. 2, foamable liquid is drawn into pumping chamber 37 as will become apparent. Subsequent compression of hand bulb 21 causes the pressure to increase in air reservoir 45. The air cannot escape through passage 47 since ball valve 49 blocks its escape, it cannot readily escape through orifice 51 because the size of the orifice is chosen to permit a relatively large pressure to be built up in air reservoir 45, and it cannot escape through the pumping chamber because diaphragm 43 isolates the pumping chamber and the foamable liquid itself from the air reservoir 45. As a result of this increasing pressure, diaphragm 43, which is a flexible membrane of rubber or other suitable material, flexes downwardly against the bias of spring 41. Foamable liquid in pumping chamber 37 is thus forced through passage 55 into mixing chamber 53 because ball valve 35 prevents its passage back through conduit 17. At the same time the pressurized foamable liquid is being forced into the mixing chamber by diaphragm 43, the excess pressure in air reservoir 45 causes pressurized air to flow through orifice 51 into the mixing chamber where the air and the foamable liquid mix to form a foam which is expelled through passage or orifice 59 to the mixing screen 61 and thereafter out through orifice 63 of nozzle 23. As hand bulb 21 is released, membrane 43 is returned by spring 41 to the position shown in FIG. 2 which causes ball valve 57 to prevent passage of the contents of mixing chamber 53 back into pumping chamber 37. Air at this time passes upwardly through passage 47 into air reservoir 45 because ball valve 49 does not block passage of the air in that direction. In addition, the upward movement of diaphragm 43 draws foamable liquid through conduit 17 from reservoir 13 into pumping chamber 37, since ball valve 35 does not block flow in that direction.

Figure 3:
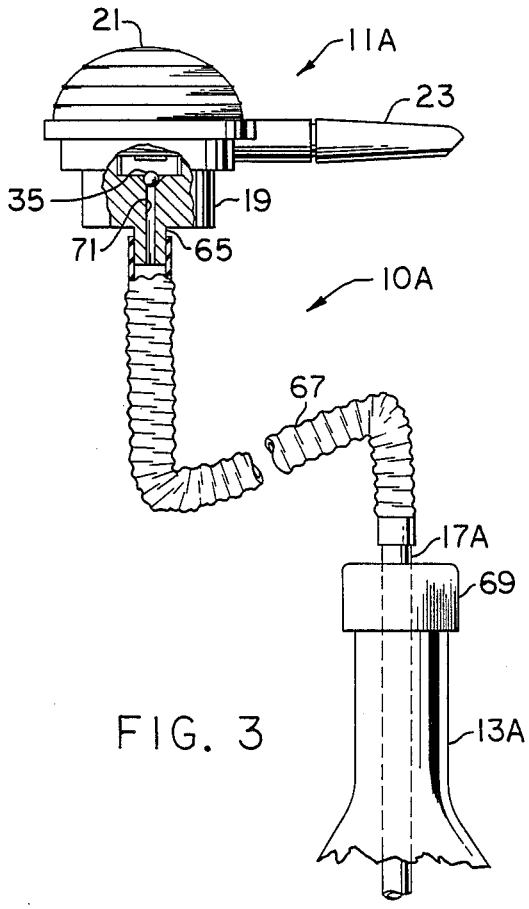
FIG. 3 is a front elevation with parts broken away for clarity of the foam dispensing device of the present invention connected to a reservoir of foamable liquid in a different manner from that shown in FIG. 1.

Turning to FIG. 3, a foam dispensing device 10A is shown similar in all respects to device 10 except that housing 19 instead of being threaded and having a downwardly depending central flange is instead solid and has a downwardly depending cylindrical member 65 to which is suitably secured a flexible tube 67 the other end of which may be secured as desired to a conduit 17A extending through the cap 69 of a reservoir 13A. Housing 19 in this embodiment has an extended central passage 71 to provide fluid communication between pumping chamber 37 and the interior of flexible tube 67. Operation of foam dispensing device 10A is the same as that described in connection with foam dispensing device 10.

Figure 5:
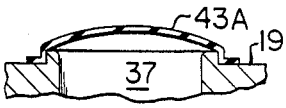
FIG. 5 is a sectional view of a portion of FIG. 4 illustrating a further alternative.
Figure 4:
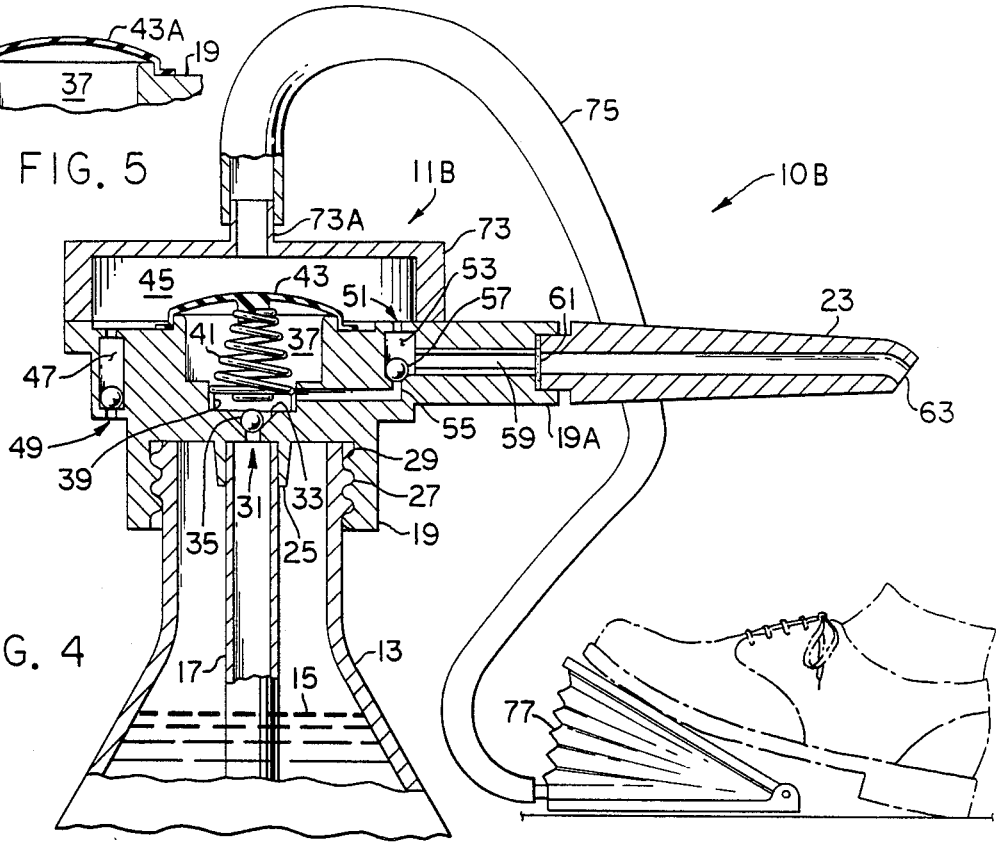
FIG. 4 is a section similar to FIG. 2 of an alternative embodiment of a foam dispensing device of the present invention.

Another embodiment of the foam dispensing device of the present invention, labelled 10B, is shown in FIG. 4. Instead of hand bulb 21, foam dispensing device 10B has a rigid cylindrical member 73 suitably secured to the top of housing 19 and defining air reservoir 45. A nipple 73A of member 73 provides fluid communication between the interior of air reservoir 45 and the interior of a flexible tube 75 which extends to a foot operated bellows 77. Operation of foam dispensing device 10B is very similar to that of foam dispensing device 10. When the foot operated bellows is depressed from the position shown in FIG. 4, the contents of pumping chamber 37 and air from air reservoir 45 are forced under pressure into mixing chamber 53 to form the foam. As the bellows are released back to the position shown in FIG. 4, more foamable liquid is drawn up into pumping chamber 37. Because of the negative pressure exerted by foot operated bellows 77 as they are returned to the position shown in FIG. 4, it is possible to dispense with biasing spring 41 as shown in FIG. 5 and rely on diaphragm 43A to provide the desired pumping action of foamable liquid into chamber 37. The diaphragm 43A can also be used with the dispensing devices 10 and 10A.

Figure 6:
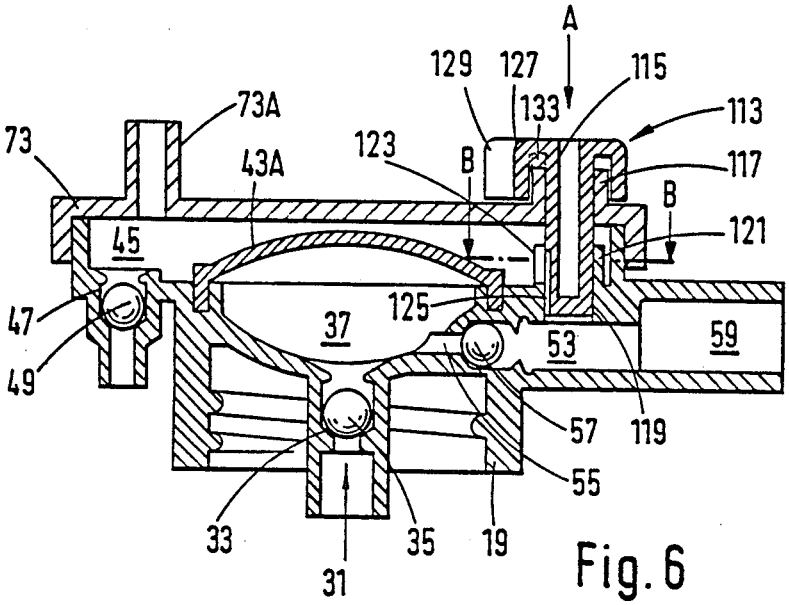
FIG. 6 is a sectional view of an embodiment of the foam dispensing device according to the invention which allows a foamable liquid to be dispensed either as a foam or as the liquid itself.
Figure 7:
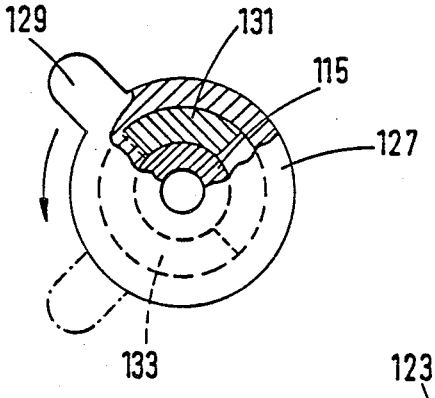
FIG. 7 is a top view with part broken away of a portion of FIG. 6 in the direction of the arrow A.
Figure 8:
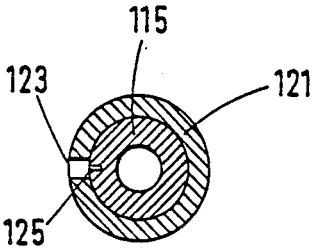
FIG. 8 is a section of part of FIG. 6 along the line B—B.

FIGS. 6–8 illustrate an embodiment of the invention which enables foamable liquid to be dispensed as desired either as a foam or as the liquid itself. The device is generally similar to the device of FIGS. 4 and 5 and is intended to be used in the same way although the bellows 77 and the reservoir 13 which are shown in FIG. 4 are not shown in FIG. 6. As in FIG. 5, the device does not incorporate a spring 41 and relies on the diaphragm 43A to provide the pumping action. The second passage (orifice) 51 of FIGS. 4 and 5 is replaced by a valve indicated generally in FIG. 6 as 113 which allows the connection between air reservoir 45 and mixing chamber 53 to be open or closed as desired. When the connection is open the device will dispense foam in the manner described above in respect of FIG. 4. When the connection is closed no air will enter the mixing chamber from air reservoir 45 to cause foaming and the foamable liquid will be dispensed as a liquid.

The valve 113 comprises a pin 115 passing through a second nipple 117 in the member 73, the pin being seated in an aperture 119 between the air reservoir 45 and the mixing chamber 53 and rotatable in the second nipple 117 and aperture 119. The side of the aperture 119 adjacent to the air reservoir 45 has a rim 121 which is provided with a slit 123. The pin 115 is provided with a groove 125 so that when the groove 125 is opposite the slit 123 (as shown in FIGS. 6 and 8) a connection is made between air reservoir 45 and mixing chamber 53. When the groove 125 is not opposite the slit 123, no such connection is made.

The pin 115 is provided with a cap 127 having a projection 129 which indicates the position of the groove 125 relative to the slit 123 (i.e. whether the connection between the air reservoir 45 and the mixing chamber 53 is open or not). Rotation of the pin 115 is restricted by a shoulder 131 extending for one-fourth of the circumference of the rim 117 and a corresponding bead 133 extending around half of the circumference of the pin 115 inside the cap 127. The shoulder 131 is shown in the part of FIG. 7 which is broken away and the bead 133 is shown by dashed lines under the cap 127. The shoulder 131 and the bead 133 cooperate to restrict rotation of the pin 115 to one-fourth of a turn and are positioned so that at one end of the possible rotation of the pin the connection between the air reservoir is open and at the other end of the possible rotation it is closed. In FIG. 7, the projection 129 is shown in the position corresponding to the connection being open, with its position at the other end of the possible rotation of the pin 115 (connection closed) being shown by dashed lines.

Figure 9:
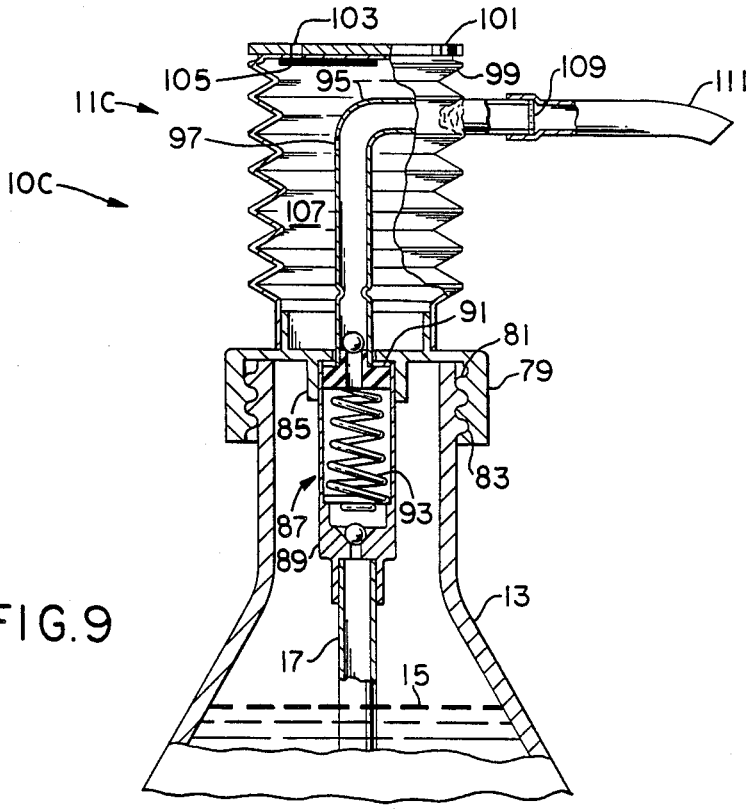
FIG. 9 is an elevation with parts broken away for clarity of another embodiment of the foam dispensing device of the present invention.

Turning now to FIG. 9, an additional embodiment 10C of the foam dispensing device of the present invention includes a housing 79 having internal threads 81 for securing unit 11C to the mating threads 83 of reservoir 13. Housing 79 includes a central annular depending flange 85 in which is secured a conventional plunger dispensing mechanism 87. Conduit 17 is secured to the bottom of conventional mechanism 87. Plunger mechanism 87 includes a plunger housing 89 in which a plunger 91 is slidingly secured. The plunger is biased to the position shown in FIG. 6 by a spring 93 inside housing 89. Plunger 91 is actuated by a rigid L-shaped tube 95 which is in fluid communication with the interior of housing 89 and has therein an air inlet 97. Rigid L-shaped tube 95 is disposed for all of its upward extent in a bellows 99 having an upper surface 101 through which an orifice 103 extends. A flap 105 is provided which allows air to enter the interior 107 of bellows 99 but which prevents air from escaping from the bellows through orifice 103. Rigid tube 95 extends outside bellows 99 and terminates in a mixing screen 109 which is surrounded by an outlet nozzle 111.

To operate foam dispensing device 10C, the user presses down on top surface 101 of bellows 99 which causes the air pressure in air reservoir 107 (the interior of bellows 99) to increase. As the bellows are compressed, surface 101 presses against rigid tube 95 which forces plunger 91 downwardly against the resistance of spring 93. This causes foamable liquid which was present in the interior of housing 89 to be forced up through tube 95. At air inlet 97, this foamable liquid mixes with the air forced through inlet 97 by the increased pressure in air reservoir 107 to form a foam. This foam is then forced out through mixing screen 109 and nozzle 111. When top surface 101 of bellows 99 is released, air enters the bellows through orifice 103 and plunger 91 returns to its position shown in FIG. 6, which draws additional foamable liquid up into the interior of housing 89.

I claim:

1. A foam dispensing device for mixing a foamable liquid with ambient air and dispensing a foam, the device comprising:

(a) a liquid reservoir adapted to contain a quantity of foamable liquid which continuously remains at atmospheric pressure during foam dispension;

(b) a compressible air supplying means adapted to supply air at superatmospheric pressure when compressed and to replenish its air supply when released;

(c) a mixing chamber in which the foamable liquid from the liquid reservoir and the air from the air supplying means can mix to form a foam;

(d) a compressible liquid pumping chamber adjacent to but separated from the air supplying means by a flexible diaphragm which depresses to pressurize the liquid pumping chamber when the air supplying means is compressed and which returns to its original position by the natural resiliency of the diaphragm and without the action of a coiled spring to vacuumize the liquid pumping chamber when the air supplying means is released;

(e) a valved passage between the liquid reservoir and the liquid pumping chamber which closes when the air supplying means is compressed and opens when the air supplying means is released to permit the flow of the foamable liquid from the liquid reservoir at atmospheric pressure to the liquid pumping chamber under vacuum;

(f) a valve passage between the ambient air and the air supplying means which closes when the air supplying means is compressed and opens when the air supplying means is released to permit the flow of ambient air to the air supplying means;

(g) a valved passage from the liquid pumping chamber to the mixing chamber which closes when the air supplying means is released and opens when the air supplying means is compressed to permit the flow of the foamable liquid from the liquid pumping chamber to the mixing chamber;

(h) a restricted passage from the air supplying means to the mixing chamber, the restriction being such that it permits the flow of sufficient air to form a foam with the foamable liquid in the mixing chamber, but which also permits sufficient pressurization of the air supplying means upon compression to depress the flexible diaphragm and thereby pressurize the liquid pumping chamber; and (i) a means for dispensing the foam from the mixing chamber.

* * * * *